US011668505B2

(12) United States Patent
Cluff et al.

(10) Patent No.: US 11,668,505 B2
(45) Date of Patent: Jun. 6, 2023

(54) HVAC HEATING SYSTEM AND METHOD

(71) Applicant: Carrier Corporation, Palm Beach Gardens, FL (US)

(72) Inventors: Charles A. Cluff, Zionsville, IN (US); Jun Pyo Lee, Zionsville, IN (US); Sathish R. Das, Indianapolis, IN (US); Charles A. Seymour, Clayton, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 478 days.

(21) Appl. No.: 16/755,021

(22) PCT Filed: Oct. 3, 2018

(86) PCT No.: PCT/US2018/054132
§ 371 (c)(1),
(2) Date: Apr. 9, 2020

(87) PCT Pub. No.: WO2019/074738
PCT Pub. Date: Apr. 18, 2019

(65) Prior Publication Data

US 2020/0348062 A1 Nov. 5, 2020

Related U.S. Application Data

(60) Provisional application No. 62/570,292, filed on Oct. 10, 2017.

(51) Int. Cl.
*F25B 49/02* (2006.01)
*F25B 31/00* (2006.01)

(52) U.S. Cl.
CPC ..... *F25B 49/022* (2013.01); *F25B 31/002* (2013.01); *F25B 2313/008* (2013.01);
(Continued)

(58) Field of Classification Search
CPC ..... F25B 49/022; F25B 31/002; F25B 2313/008; F25B 2700/1931;
(Continued)

(56) References Cited

U.S. PATENT DOCUMENTS 2,066,869 A 1/1978 Apaloo et al.
4,066,869 A 1/1978 Apaloo et al.
(Continued)

FOREIGN PATENT DOCUMENTS

CN 2050090499 U 3/2016
EP 2631485 B1 4/2014
(Continued)

OTHER PUBLICATIONS

Air conditioner and method for controlling airconditioner, Kato, 2013, Full Document (Year: 2013).*
(Continued)

*Primary Examiner* — Nael N Babaa
(74) *Attorney, Agent, or Firm* — Cantor Colburn LLP

(57) ABSTRACT

A method of heating a component within a heating, ventilation and air conditioning (HVAC) system is provided. The method includes maintaining a non-heating condition of the HVAC system component when the HVAC system component is in a non-operational state. The method also includes determining when the HVAC system component will switch from the non-operational state to an operational state, the determination based on a threshold parameter being met. The method further includes operating a heating device from the non-heating condition to a heating condition to heat the HVAC system component from a temperature to a target temperature suitable for the operational state of the HVAC system component.

14 Claims, 3 Drawing Sheets

(52) U.S. Cl.
CPC ..... *F25B 2700/1931* (2013.01); *F25B 2700/1933* (2013.01); *F25B 2700/2106* (2013.01); *F25B 2700/2115* (2013.01)

(58) Field of Classification Search
CPC ..... F25B 2700/1933; F25B 2700/2106; F25B 2700/2115
See application file for complete search history.

(56) References Cited

U.S. PATENT DOCUMENTS

| | | | |
|---|---|---|---|
| 4,480,174 | A | 10/1984 | Hummel |
| 4,995,792 | A | 2/1991 | Brown et al. |
| 5,012,652 | A | 5/1991 | Dudley |
| 5,970,727 | A | 10/1999 | Hiraoka et al. |
| 6,396,033 | B1 | 5/2002 | Renwick et al. |
| 6,434,957 | B1 | 8/2002 | Nishizuka et al. |
| 7,085,626 | B2 | 8/2006 | Harrod et al. |
| 8,116,911 | B2 | 2/2012 | Bailey et al. |
| 9,482,222 | B2 | 11/2016 | Perez et al. |
| 9,581,985 | B2 | 2/2017 | Walser et al. |
| 2010/0011788 | A1 | 1/2010 | Lifson et al. |
| 2014/0000295 | A1 | 1/2014 | Schuster |
| 2014/0124166 | A1 | 5/2014 | Fraser et al. |
| 2016/0153688 | A1 | 6/2016 | Ronk et al. |
| 2016/0327323 | A1 | 11/2016 | Goel |
| 2019/0178516 | A1* | 6/2019 | Lau ..... G05B 19/042 |

FOREIGN PATENT DOCUMENTS

| | | | | |
|---|---|---|---|---|
| EP | 2960598 | A1 * | 12/2015 | ..... F24F 11/008 |
| EP | 2960598 | A1 | 12/2015 | |
| EP | 3147590 | A1 | 3/2017 | |

OTHER PUBLICATIONS

International Search Report and Written Opinion for application PCT/US2018/054132, dated, Jan. 4, 2019, U301373PCT, 13 pages.
Wikipedia: "Crankcase heater," Oct. 30, 2016; retrieved from the internet; URL:https://en.wikipedia.org/w/index.php?title=Crankcase_heater&oldid=746857985; retrieved on Dec. 13, 2018; 3 pgs.

* cited by examiner

HVAC HEATING SYSTEM AND METHOD

BACKGROUND

This disclosure relates generally to climate control systems and, more particularly, to a system and method of providing heat to a component of a heating, ventilation and air conditioning system.

Heating, ventilation and air conditioning (HVAC) systems typically include a compressor and refrigerant. The refrigerant of the system tends to migrate to, and collect as a liquid in, the coldest part of the system when the system is not operating. This part of the system is often the compressor, resulting in liquid refrigerant accumulating in the compressor sump. The compressor sump is usually heated to prevent this from happening. Heating of the compressor sump is typically nearly constantly applied. During long periods of system non-operation, heat energy provided to the compressor sump is lost to the environment without providing any benefit and results in reduced system operating efficiency.

BRIEF SUMMARY

Disclosed is a method of heating a component within a heating, ventilation and air conditioning (HVAC) system. The method includes maintaining a non-heating condition of the HVAC system component when the HVAC system component is in a non-operational state. The method also includes determining when the HVAC system component will switch from the non-operational state to an operational state, the determination based on a threshold parameter being met. The method further includes operating a heating device from the non-heating condition to a heating condition to heat the HVAC system component from a temperature to a target temperature suitable for the operational state of the HVAC system component.

In addition to one or more of the features described above, or as an alternative, further embodiments may include that the HVAC system component comprises a compressor and the heating device provides heat to a compressor sump.

In addition to one or more of the features described above, or as an alternative, further embodiments may include that the heating device applies heat to the HVAC system component at a single power level.

In addition to one or more of the features described above, or as an alternative, further embodiments may include that the heating device applies heat to the HVAC system component at a plurality of power levels.

In addition to one or more of the features described above, or as an alternative, further embodiments may include that the temperature of the compressor sump is inferentially determined.

In addition to one or more of the features described above, or as an alternative, further embodiments may include that the temperature of the compressor sump is determined from a known temperature of a body portion of the compressor.

In addition to one or more of the features described above, or as an alternative, further embodiments may include that the known temperature of the body portion of the compressor is based on a thermal sensor mounted to the body portion.

In addition to one or more of the features described above, or as an alternative, further embodiments may include that the thermal sensor is mounted to the compressor proximate the compressor sump.

In addition to one or more of the features described above, or as an alternative, further embodiments may include that the temperature of the compressor sump is determined from a known temperature of at least one tube in fluid communication with the compressor.

In addition to one or more of the features described above, or as an alternative, further embodiments may include that the temperature of the compressor sump is determined from an outdoor ambient temperature and an anticipated temperature change based on heat energy applied or removed over a time interval.

In addition to one or more of the features described above, or as an alternative, further embodiments may include that the target temperature of the compressor sump is based on a static pressure inside the compressor.

In addition to one or more of the features described above, or as an alternative, further embodiments may include that the target temperature of the compressor sump is based on a static pressure proximate at least one of a compressor inlet location and a compressor discharge location.

In addition to one or more of the features described above, or as an alternative, further embodiments may include that determining when the HVAC system component will switch from the non-operational state to the operational state comprises generation of a pre-operation alert from a thermostat in operative communication with the heating system.

In addition to one or more of the features described above, or as an alternative, further embodiments may include that determining when the HVAC system component will switch from the non-operational state to the operational state comprises monitoring ambient temperature of the environment surrounding the HVAC system component relative to a known lockout temperature threshold of the heating system.

In addition to one or more of the features described above, or as an alternative, further embodiments may include disabling heating of the compressor sump when the non-operative state of the compressor is known to be greater than a predetermined heating time.

Also disclosed is a method of heating a heating, ventilation and air conditioning (HVAC) system component. The method includes maintaining a compressor sump temperature relative to a secondary component temperature.

In addition to one or more of the features described above, or as an alternative, further embodiments may include that maintaining the compressor sump temperature comprises disabling heating when the secondary component temperature is colder than the compressor sump temperature.

In addition to one or more of the features described above, or as an alternative, further embodiments may include that maintaining the compressor sump temperature comprises controlling heating of the compressor sump to be higher than the secondary component temperature.

BRIEF DESCRIPTION OF THE DRAWINGS

The present disclosure is illustrated by way of example and not limited in the accompanying figures in which like reference numerals indicate similar elements.

DETAILED DESCRIPTION

As described herein, methods for more efficiently consuming energy associated with heating a compressor sump are provided by avoiding excessive heating, such as continuous, nearly continuous or intermittent compressor sump heating.

Figure 1:
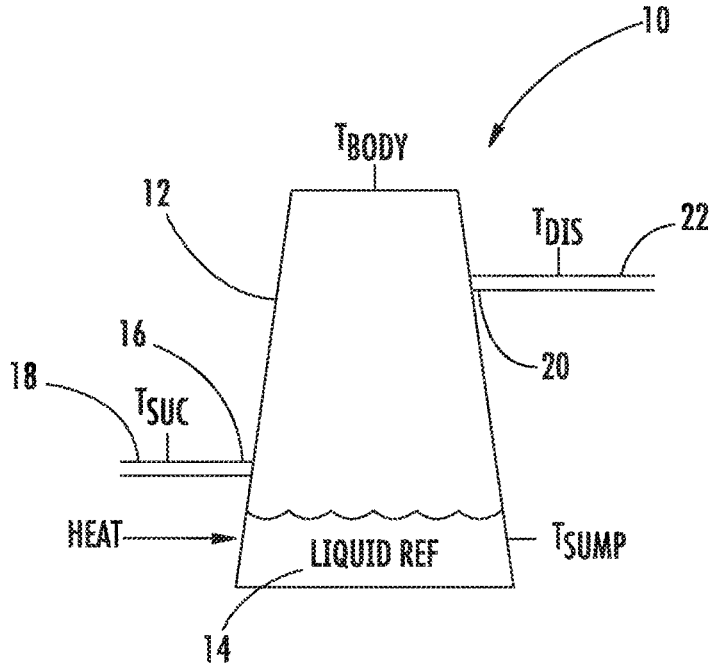
FIG. 1 is a compressor of a HVAC system.

Referring to FIG. 1, a compressor section of a HVAC system is illustrated and is generally referenced with numeral 10. The compressor section 10 includes a body portion 12 and a compressor sump 14. The compressor section 10 includes at least one inlet 16 for receiving fluid from a suction line 18. The compressor section 10 also includes at least one outlet 20 for discharging fluid from a discharge line 22. The suction line 18 and/or the discharge line 22 are formed of a metal tube in some embodiments.

As shown, liquid refrigerant may collect in the compressor sump 14 during a non-operational state of the compressor section 10. This is due at least partly to the compressor sump 14 often being the coldest part of the overall HVAC system. For the compressor section 10 to adequately perform in an operational state, the compressor sump 14 must be heated to evaporate any liquid refrigerant present in the compressor sump 14. In contrast to other heating schemes, the embodiments described herein determine the most efficient heating schedule to apply if liquid refrigerant is present in the compressor sump 14. An efficient heating schedule is determined at least in part by consideration of when the operational state of the compressor section 10 will be required. In such embodiments, heating is not applied to the compressor sump 14 until a relatively short period of time prior to operation. This is particularly desirable when the compressor section 10 is in a non-operational state for a long period of time.

In some embodiments, operation of the compressor section 10 is anticipated as a result of a "pre-operation alert" message from a control separate from the equipment containing the compressor section 10. The separate control may be a thermostat with a climate control pre-programmed schedule, for example. The alert may be generated as a readiness request timing. For example, the alert may indicate that the compressor section 10 must be ready to be operational by a specified time (e.g., five minutes after alert). In other embodiments, the pre-operation alert message is the result of a setback recovery, such as the nearing of completion of a scheduled setback during an unoccupied time period of the structure.

In some embodiments, operation of the compressor section 10 is anticipated based on monitoring ambient temperature of the environment surrounding the equipment containing the compressor section 10, relative to a known lockout temperature threshold. For example, operation may be anticipated if a heat pump lockout threshold is below a specific temperature and the outdoor temperature is well below the specific temperature. Determination of operation based on this method may be done in a number of ways. First, activation of heating may occur when the outdoor temperature approaches within a minimum difference to the threshold, wherein the minimum difference is altered by the rate of increase of the outdoor temperature (e.g., heating turns on sooner if the outdoor temperature is increasing rapidly). Second, the outdoor temperature may be measured by a sensor exposed to the outside air. Third, the outdoor temperature may be measured by a sensor in thermal contact with an object exposed to the outside air, such as the compressor body or shell. Fourth, the calculations of the temperature difference and the decision to activate heating are performed in a control separate from the equipment containing the compressor section 10 and communicated to the equipment containing the compressor section 10 (e.g., thermostat makes the decision). Fifth, the calculations of temperature difference and decision to activate heating are performed within the equipment containing the compressor section 10 (e.g., heat pump control makes the decision).

In some embodiments, compressor operation is not anticipated, but operation is delayed after the request for the period of time necessary to heat the compressor sump 14. In such embodiments, the equipment with the compressor section 10 signals to the control requesting operation that start-up will be delayed while heating occurs. The equipment with the compressor section 10 provides an estimate of the time required for heating before operation begins.

Regardless of whether compressor operation is anticipated or not, and how this is determined, heat energy is then applied from a heating device (e.g., an electric heating element) to the compressor sump 14 in preparation for compressor operation. Heating may be applied at a single power level or at a plurality of power levels. For example, constant heating at a single power level may include heating at any suitable power level. Non-limiting examples of a power level that may be applied are 50 W, 100 W or 200 W. Similarly, any suitable heating cycle at multiple power levels may be applied. The specific heating schedule and power levels will vary depending upon the application of use and the operating conditions. Non-limiting examples of heating powers are 50 W, 100 W and 200 W. When heating at multiple power levels, some embodiments include applying heat at a first higher rate (e.g., 200 W) and reducing to one or more lower rates (100 W, then 50 W) during the heating cycle. Progressively lower heating power levels allows rapid initial heating, with subsequent tuning of the heat to achieve a target temperature of the compressor sump 14.

The heating power level and schedule are determined by several factors including, but not limited to, an allotted time duration for heating prior to compressor operation, a current temperature of the compressor sump 14, and a target temperature of the compressor sump 14. There are numerous ways to determine (directly or inferentially) the compressor sump temperature. This is based on known temperature relationships and/or models that allow the compressor sump temperature to be determined based on the temperature of at least one other component of the HVAC system.

The compressor sump temperature may be determined based on a known temperature of the body portion 12 of the compressor 10. The temperature of the body portion 12 may be measured with a sensor mounted in thermal contact with the body portion 12. It is further contemplated that direct temperature measurement of the compressor sump 14 may be made with one or more sensors.

Figure 2:
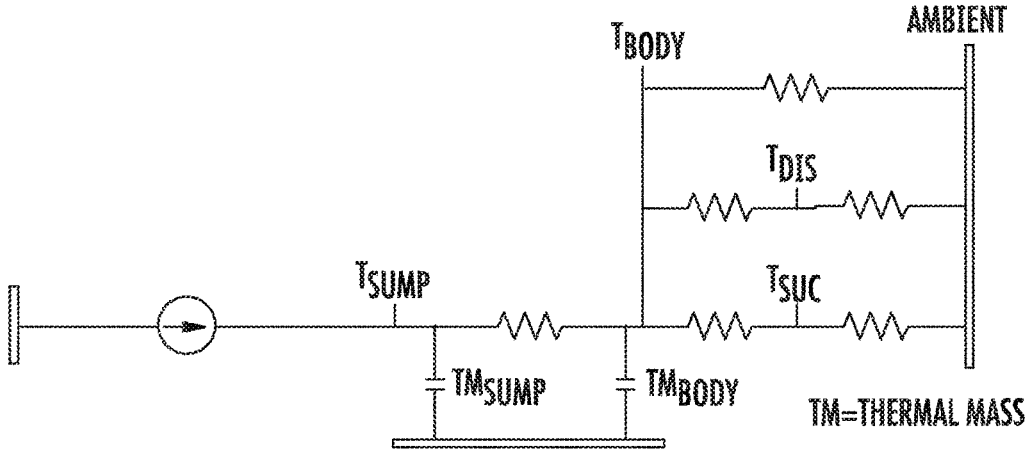
FIG. 2 is a thermal schematic illustrating a thermal model for the compressor and locations on tubing connected to the compressor where those locations are in close proximity to the compressor connection.

As an alternative to direct temperature measurement, as noted above, a thermal model of the compressor 10 may be utilized to estimate the internal temperature of the compressor sump 14. FIG. 2 illustrates a thermal schematic that may be employed in such a thermal model. In the illustrated thermal schematic, various known temperatures and resistances are used to determine the compressor sump temperature that is of interest. In some embodiments, the compressor sump temperature is estimated based on motor winding resistance measurements. In other embodiments, the compressor sump temperature is estimated based on outdoor ambient temperature and an anticipated temperature change based on heat energy applied or removed (e.g., dissipated into a colder ambient environment) over a given interval of time. In other embodiments, the compressor internal sump temperature is estimated using a thermal sensor on the body portion 12 of the compressor 10 in the sump area. In such embodiments, during rapid heating other parts of the compressor shell in the sump area will increase in temperature, but lag the internal sump temperature. In other embodiments, the compressor internal sump temperature is anticipated using one or more thermal sensors attached to the body portion 12 of the compressor 10 outside of the sump area or the suction or discharge line(s) 18, 22, respectively. In such embodiments, during rapid heating other parts of the compressor shell and tubing attached to the compressor 10 (suction and discharge lines 18, 22) will increase in temperature, but will have a greater lag relative to the internal sump temperature.

The target temperature of the compressor sump 14 may be based on the static pressure inside or near the compressor inlet or discharge. This would facilitate getting the inside of the compressor 10 above the saturation temperature, which may be best measured externally as suction pressure.

Figure 3:
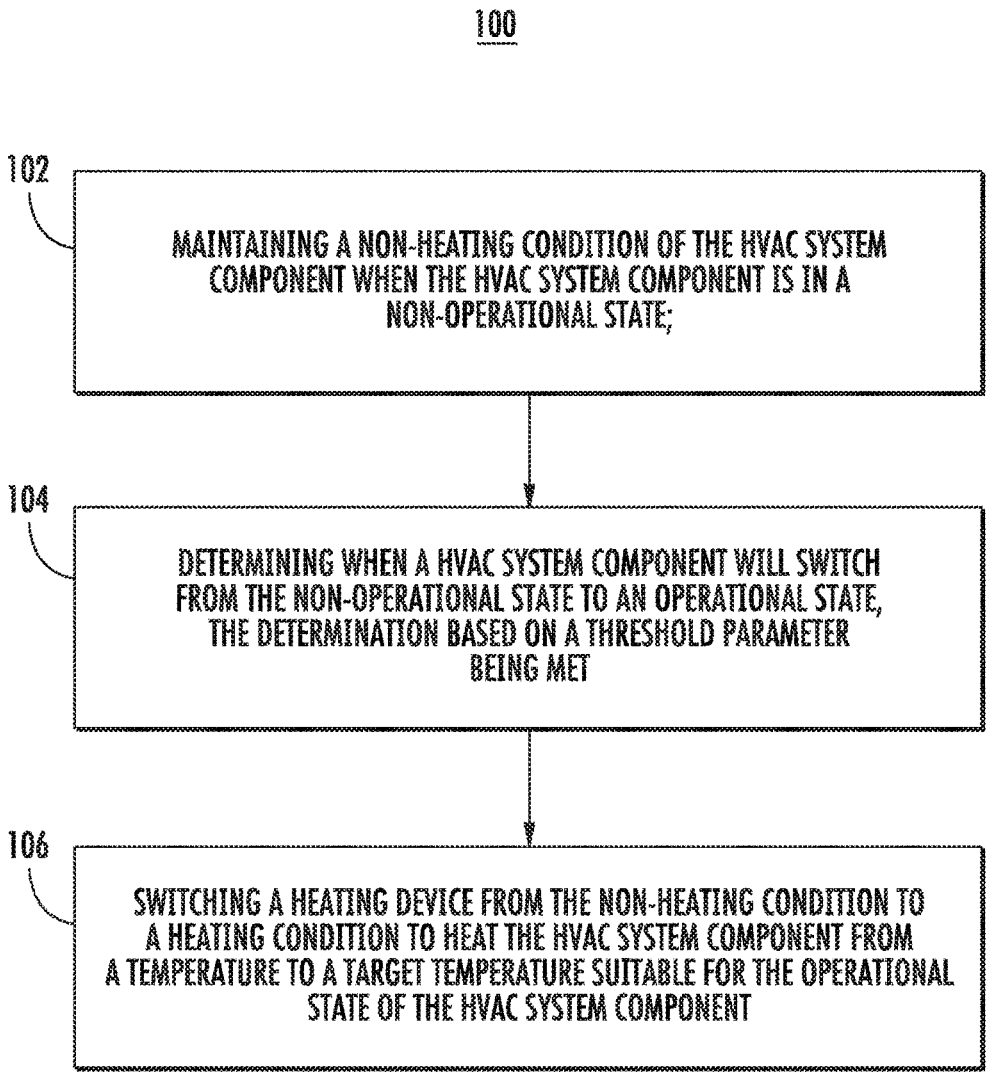
FIG. 3 is a flow diagram illustrating a method of heating a component of the HVAC system according to one aspect of the disclosure.

Referring to FIG. 3, a method of heating the HVAC system component is illustrated. The method is generally referenced with numeral 100 and includes maintaining a non-heating condition of the HVAC system component when the HVAC system component is in a non-operational state at block 102. Block 104 represents determining when a HVAC system component will switch from the non-operational state to an operational state, the determination based on a threshold parameter being met. As described above, the threshold parameter may be based on a time period until operation or a target temperature is required. Alternatively, the threshold parameter may pertain to a component temperature relative to an ambient temperature. Block 106 represents operating a heating device from the non-heating condition to a heating condition to heat the HVAC system component from a temperature to a target temperature suitable for the operational state of the HVAC system component.

Figure 4:
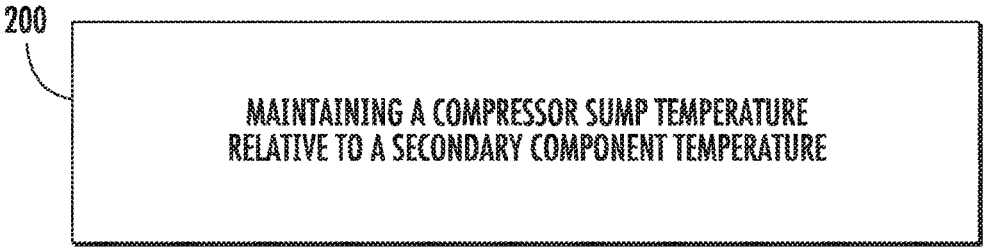
FIG. 4 is a flow diagram illustrating a method of heating a component of the HVAC system according to another aspect of the disclosure.

Referring to FIG. 4, a method of heating the HVAC system component according to another aspect of the disclosure is illustrated. The method includes maintaining a compressor sump temperature relative to a secondary component temperature at block 200.

The methods disclosed herein also provide information that may allow disabling of heating of the compressor sump 14 if one or more conditions are met. For example, heating may be disabled as a result of entering a setback period where conditioning operation will not be required for some time. This may be based on a lack of a pre-operation alert message and/or as a result of a message from the central control. Additionally, heating may be disabled when the known temperature of another part of the system is colder than the compressor 10. For example, if an outside coil is colder than the compressor 10, the liquid refrigerant will be in the coil rather than inside the compressor 10.

The methods disclosed herein also allow compressor heating to be controlled to maintain a compressor temperature higher than the temperature(s) of one or more other parts of the system where liquid refrigerant may accumulate.

The embodiments disclosed herein facilitate the reduction to the minimum level possible of heating energy provided to the compressor prior to start-up. The reduction of wasted energy inherently improves system efficiency. System rating tests include energy consumed during off-cycles when compressor heating is used. The methods disclosed herein will improve the efficiency rating of equipment by reducing power consumption during off-cycles.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., a processor, apparatus or system) to perform one or more methodological acts as described herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

What is claimed is:

1. A method of heating a component within a heating, ventilation and air conditioning (HVAC) system comprising:

maintaining a non-heating condition of the HVAC system component when the HVAC system component is in a non-operational state;

determining when the HVAC system component will switch from the non-operational state to an operational state, the determination based on a threshold parameter being met; and operating a heating device from the non-heating condition to a heating condition to heat the HVAC system component from a temperature to a target temperature suitable for the operational state of the HVAC system component;

wherein determining when the HVAC system component will switch from the non-operational state to the operational state comprises monitoring ambient temperature of the environment surrounding the HVAC system component relative to a known lockout temperature threshold of the heating system.

2. The method of claim 1, wherein the HVAC system component comprises a compressor and the heating device provides heat to a compressor sump.

3. The method of claim 1, wherein the heating device applies heat to the HVAC system component at a single power level.

4. The method of claim 1, wherein the heating device applies heat to the HVAC system component at a plurality of power levels.

5. The method of claim 2, wherein the temperature of the compressor sump is inferentially determined.

6. The method of claim 5, wherein the temperature of the compressor sump is determined from a known temperature of a body portion of the compressor.

7. The method of claim 6, wherein the known temperature of the body portion of the compressor is based on a thermal sensor mounted to the body portion.

8. The method of claim 7, wherein the thermal sensor is mounted to the compressor at the compressor sump.

9. The method of claim 5, wherein the temperature of the compressor sump is determined from a known temperature of at least one tube in fluid communication with the compressor.

10. The method of claim 5, wherein the temperature of the compressor sump is determined from an outdoor ambient temperature and an anticipated temperature change based on heat energy applied or removed over a time interval.

11. The method of claim 2, wherein the target temperature of the compressor sump is based on a static pressure inside the compressor.

12. The method of claim 2, wherein the target temperature of the compressor sump is based on a static pressure at at least one of a compressor inlet location and a compressor discharge location.

13. The method of claim 1, wherein determining when the HVAC system component will switch from the non-operational state to the operational state comprises generation of a pre-operation alert from a thermostat in operative communication with the heating system.

14. The method of claim 2, further comprising disabling heating of the compressor sump when the non-operative state of the compressor is known to be greater than a predetermined heating time.

* * * * *